United States Patent [19]

von Winckelmann

[11] 4,099,651

[45] Jul. 11, 1978

[54] CLOSURE ASSEMBLY FOR COLLAPSIBLE TUBE DISPENSERS, AND THE LIKE

[76] Inventor: Emil H. von Winckelmann, 7731 Amestoy Ave., Van Nuys, Calif. 91406

[21] Appl. No.: 579,786

[22] Filed: May 22, 1975

[51] Int. Cl.[2] ..... B65D 35/50

[52] U.S. Cl. ..... 222/94; 222/494

[58] Field of Search ..... 222/94, 129, 490, 494, 222/562

[56] References Cited

U.S. PATENT DOCUMENTS

| | | | |
|---|---|---|---|
| 1,731,816 | 10/1929 | Garhart | 222/562 |
| 2,218,092 | 10/1940 | Nitardy | 222/94 |
| 3,348,744 | 10/1967 | Morin | 222/494 |
| 3,788,520 | 1/1974 | Dukess | 222/94 |

FOREIGN PATENT DOCUMENTS

| | | | |
|---|---|---|---|
| 109,109 | 11/1939 | Australia | 222/494 |
| 747,465 | 6/1933 | France | 222/494 |
| 851,429 | 1/1940 | France | 222/494 |
| 426,625 | 6/1967 | Switzerland | 222/494 |

*Primary Examiner*—Robert B. Reeves
*Assistant Examiner*—David A. Scherbel
*Attorney, Agent, or Firm*—Keith D. Beecher

[57] ABSTRACT

A closure assembly is provided which is mounted on the end of a collapsible tube or pouch dispenser through which liquid or soft solid substances such as toothpaste, shaving cream, catsup, mustard, shampoo, glue, and the like, may be dispensed. The closure assembly allows the particular substance to flow through it only when the tube is squeezed, and it automatically closes to prevent further flow of the substance when the squeezing pressure is removed. The closure member includes a tubular tip mounted on the mouth of the collapsible tube. The distal end of the tip is flattened, and an opening is provided on one or both sides of the flattened end of the tip, with the opening extending into the interior of the tip. A flexible open-ended sleeve is drawn over the flattened end of the tip and over the opening, and the sleeve normally exhibits a closed slit at its distal end to seal the opening and to maintain the particular substance in the tube. However, when a squeezing pressure is applied to the collapsible tube, the substance in the tube is forced through the openings in the tip, and between the flattened end of the tip and the sleeve, to be dispensed through the slot at the end of the sleeve so long as the squeezing pressure is applied.

3 Claims, 11 Drawing Figures

CLOSURE ASSEMBLY FOR COLLAPSIBLE TUBE DISPENSERS, AND THE LIKE

BACKGROUND OF THE INVENTION

Closure assemblies for use with collapsible tube dispensers are known to the art, and which serve to control the discharge of liquids and soft solids from the collapsible tube, the closures being intended to close automatically and cut off the flow of the substance when the squeezing pressure is removed. However, the prior art closure assemblies of this general type for the most part are bulky and cumbersome, and they do not adequately function as a complete and sanitary seal to prevent further discharge of the substance, and to provide an air-tight seal for the substance in the tube, when the squeezing pressure is removed.

The closure apparatus of the present invention, on the other hand, in its various embodiments serves as a complete closure for the substance in the collapsible tube until a squeezing pressure is applied to the tube, and then the closure acts to dispense a desired amount of the substance from the tube so long as the squeezing pressure is maintained. The closure assembly of the invention is strong, durable, and efficient in operation. Moreover, the closure assembly of the invention is sanitary, and it is capable of forming an air-tight seal to prevent further discharge of the substance in the tube, and to serve as a protecting means for the substance, whenever the squeezing pressure is removed. Moreover, the closure assembly of the invention, as will be described, is simple and inexpensive in its construction, and it is easy to use.

DETAILED DESCRIPTION OF THE ILLUSTRATED EMBODIMENTS

Figure 1:
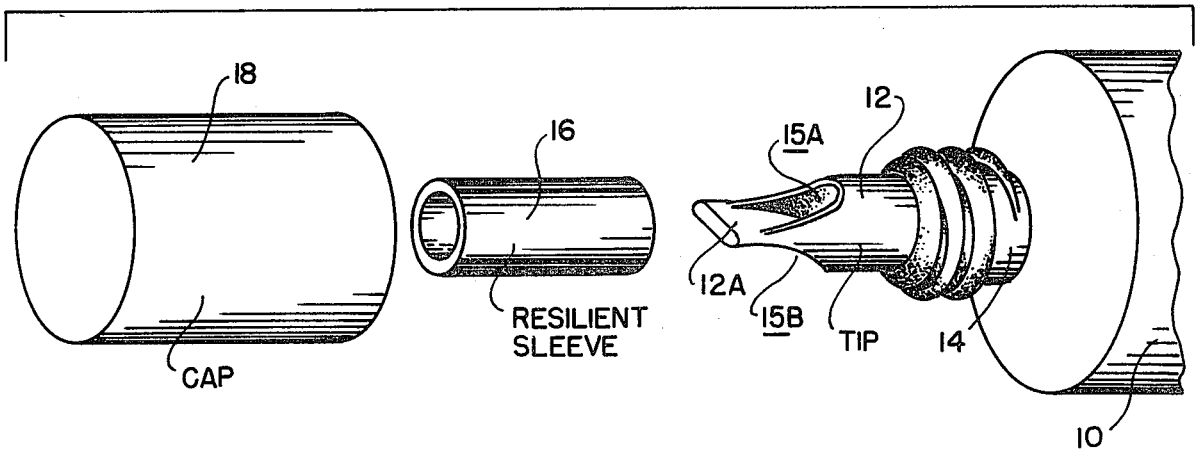
FIG. 1 is an exploded perspective representation showing one embodiment of the closure assembly of the invention in which a rigid tubular tip is formed in the mouth of a collapsible tube dispenser, the closure assembly including other components which fit over the tip, as will be described.
Figure 2:
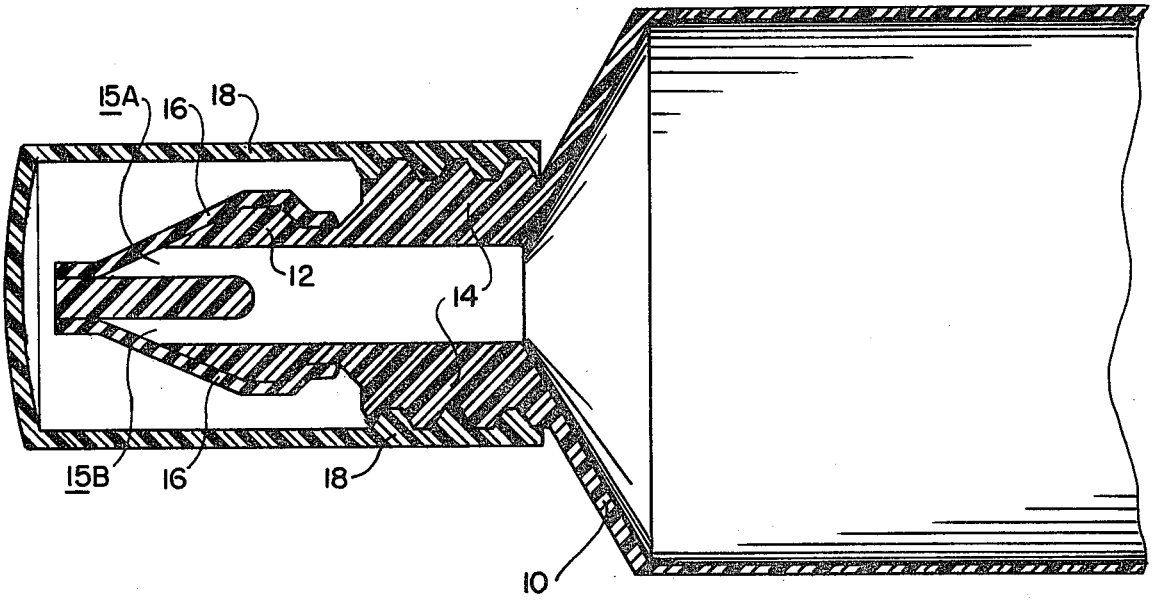
FIG. 2 is a side section of the assembly of FIG. 1.

In the embodiment of FIGS. 1 and 2, a collapsible tube 10 is provided with a hollow tubular nozzle tip 12 formed integral with the neck 14 of the tube. The neck 14 is threaded, as shown. The tip 12 may be formed of any appropriate rigid plastic, or other suitable material, and, as shown, is formed so that its distal end 12A has a flattened configuration. The rigid tip 12 also has openings, such as the opening 15A, 15B which extend on either side of the flattened tip 12A, into the interior of the tip.

An open-ended flexible sleeve 16, formed of rubber, or other appropriate material is drawn over the nozzle tip 12 into the position shown in FIG. 2 so that it closes the openings 15A, 15B and extends over the flattened end 12A of the tip to have the configuration of a closed slit at its end remote from the neck 14.

When there is no suqeezing pressure applied to the wall of the collapsible tube 10, the open-ended sleeve 16 forms a complete air-tight seal around the tip 12A and over the openings 15A, 15B protecting the fluid within the tube, and also preventing any fluid from passing through the openings. However, when a squeezing pressure is applied to the tube 10, the fluid is forced through the openings 15A, 15B and between the sleeve and the flattened end 12A of the tip 12, and through the slit at the remote end of the sleeve.

A cap 18 may be provided to cover the assembly when not in use, the cap 18, in the embodiment of FIG. 1 being threaded onto the neck 14. Under normal operations the cap 18 is not required, since the closure assembly forms a complete seal for the contents of the tube. However, the cap may prove useful when the tube is packed for traveling purposes.

Figure 3:
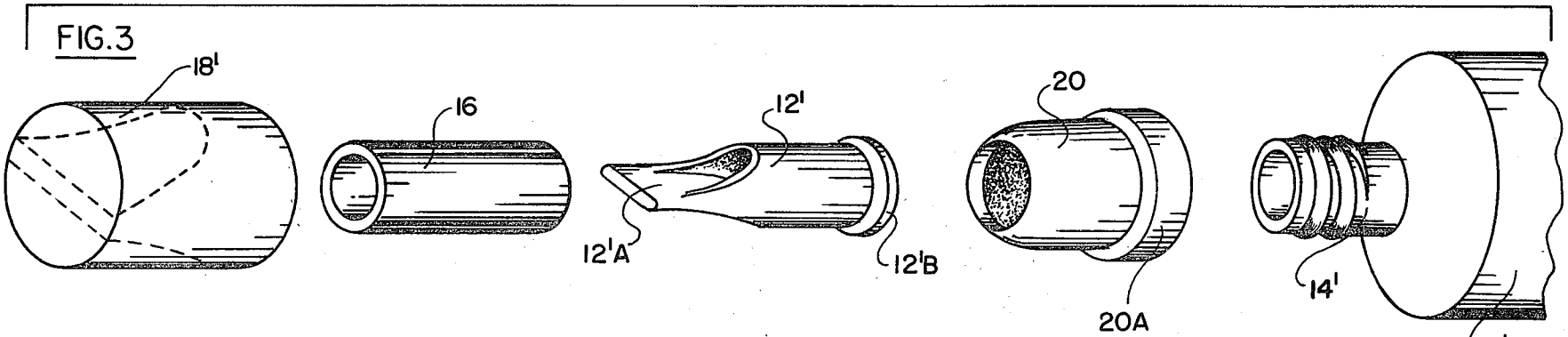
FIG. 3 is an exploded perspective view of a second embodiment, in which the rigid tip member is separate from the tube itself, and is held on the end of the tube by an appropriate bushing.
Figure 5:
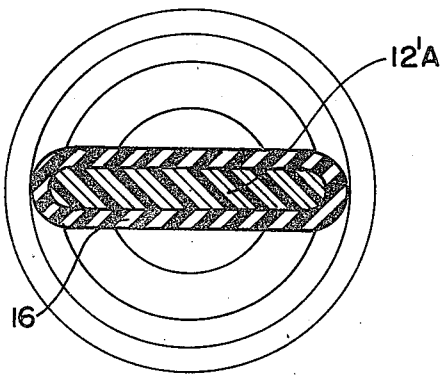
FIG. 5 is an end view of the assembly of FIG. 4 taken essentially along the line 5—5 of FIG. 4.
Figure 4:
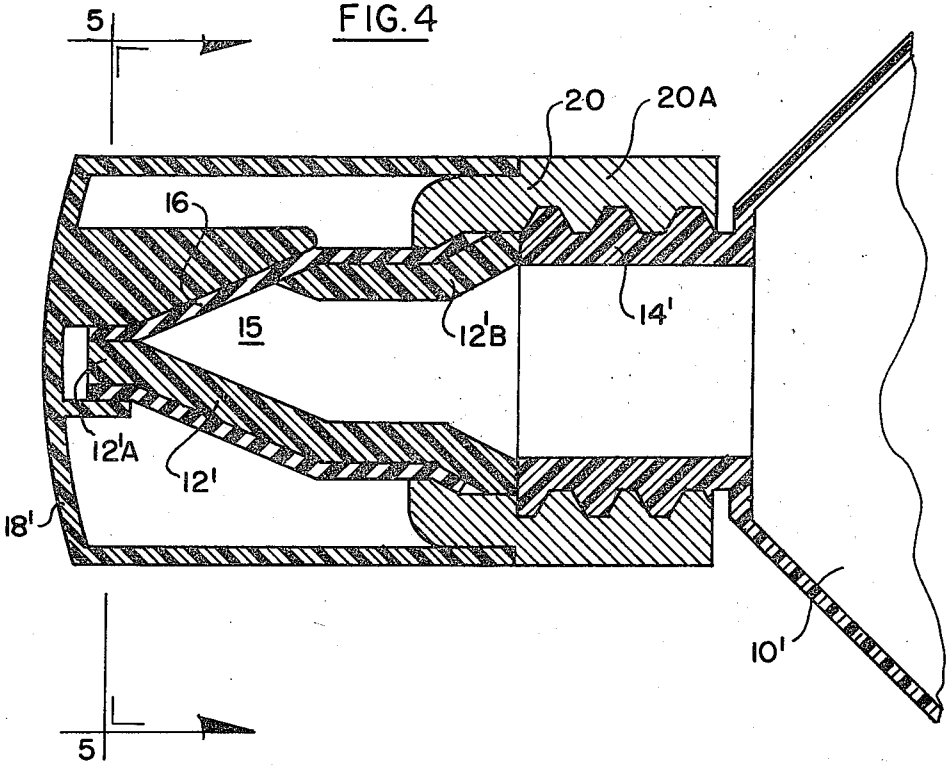
FIG. 4 is a side section of the embodiment of FIG. 3.

The embodiment of FIGS. 3, 4 and 5 is similar to the embodiment of FIGS. 1 and 2, and like elements have been designated by the same numbers. In the embodiment of FIG. 3, however, the bushing 20 of the tube 10' is provided with a collar 20A which receives the cap 18' with a snap-on friction fit, rather than the cap being threaded to the neck. The cap 18', as shown, has an internal configuration to fit directly over the sleeve 16 and tip 12', positively to lock the sleeve in a closed condition.

In the embodiment of FIG. 3, the tip 12' has a flange 12'B at its right-hand end which extends radially outwardly, as shown. A bushing 20 is fitted over the tip 12' and is threaded to the neck 14 to engage the flange 12'B, as shown in FIG. 4, to hold the tip securely on the neck of the tube. It will be noted in FIG. 4 that the bushing 20 also serves to lock the end of the sleeve 16 against the flange 12'B, securely to hold the sleeve on the tip 12', thereby forming an air-tight seal with the neck 14'.

Figures 6, 7:
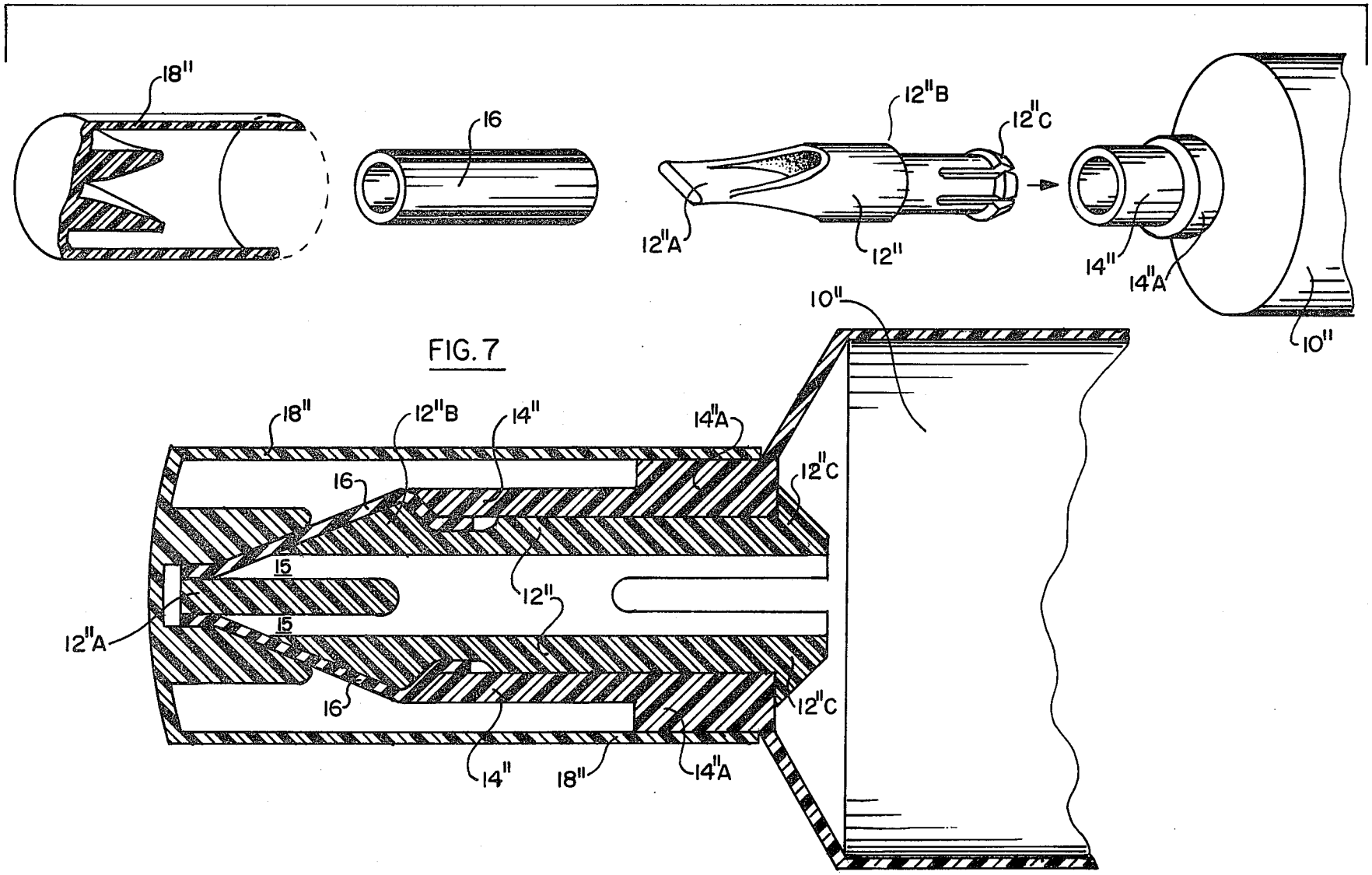
FIG. 6 is an exploded perspective view of a third embodiment of the invention in which the rigid tubular tip fits into the neck of the collapsible tube and is configured to be held in position within the tube without the need for a separate bushing, as in the embodiment of FIG. 3.
FIG. 7 is a side section of the embodiment of FIG. 6.

In the embodiment of FIGS. 6 and 7, the rigid nozzle tip 12" has a shoulder 12"B and a flange 12"C. Longitudinal slots are provided in the tip which extends through the flange 12"C to permit the tip to be inserted into the neck 14" of the tube 10", so that the flange 12"C may engage an internal collar in the tube, so as to hold the assembly in place, as shown in FIG. 7. In the latter embodiment, and as shown in FIG. 7, the sleeve 16 is held firmly in place between the neck 14 and shoulder 12"B.

Figures 8, 9:
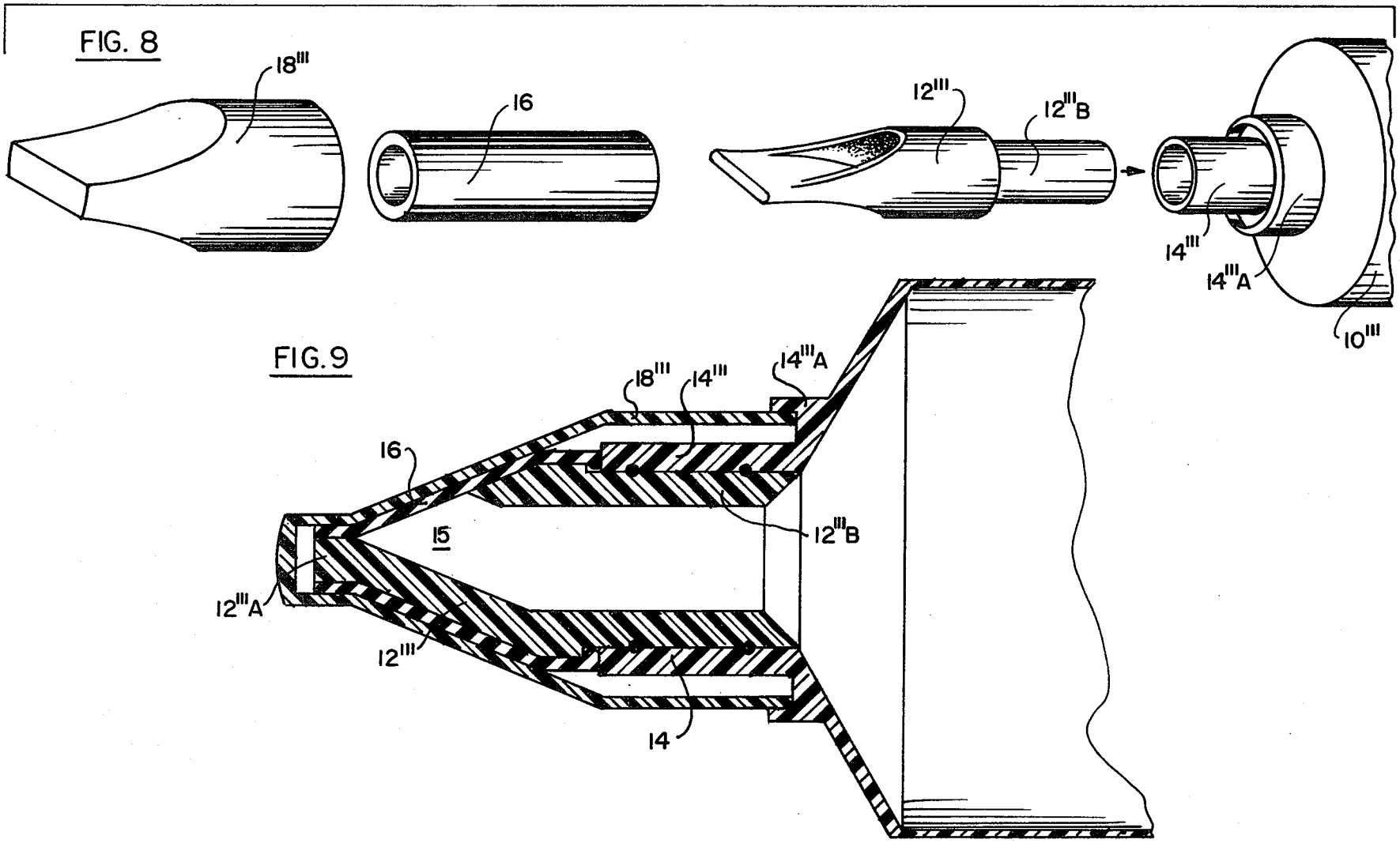
FIG. 8 is a perspective representation of a third embodiment in which the tip member is adhesively or otherwise attached to the neck of the collapsible tube.
FIG. 9 is a side section of the embodiment of FIG. 8.

In the embodiment of FIGS. 8 and 9, the tip 12''' has its right-hand end 12'''B formed of reduced diameter, so that it may be inserted into the neck 14''' of the tube 10''', and adhesively attached to the bore surface of the neck by heat sealing, sonic weld, adhesive, or other suitable attachment. If desired, the nozzle tips 12, 12', 12'' or 12''' may be threaded to the neck 14, 14', 14'' or 14'''.

Figure 11:
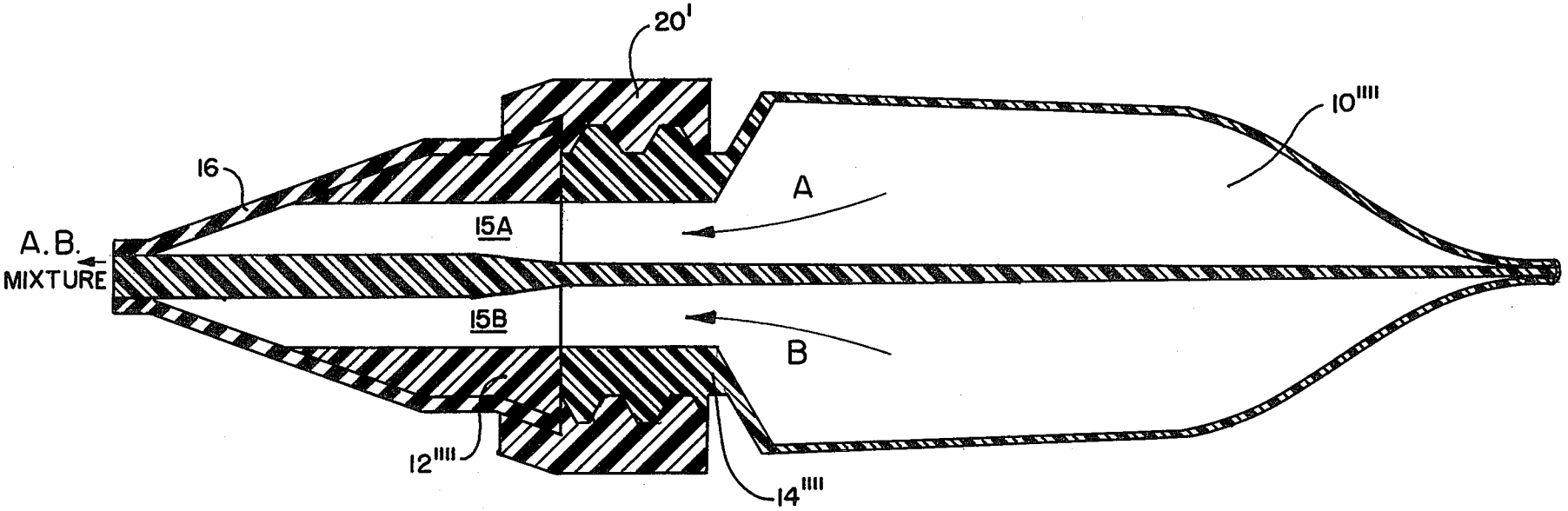
FIG. 11 is a side section of the embodiment of FIG. 10.
Figure 10:
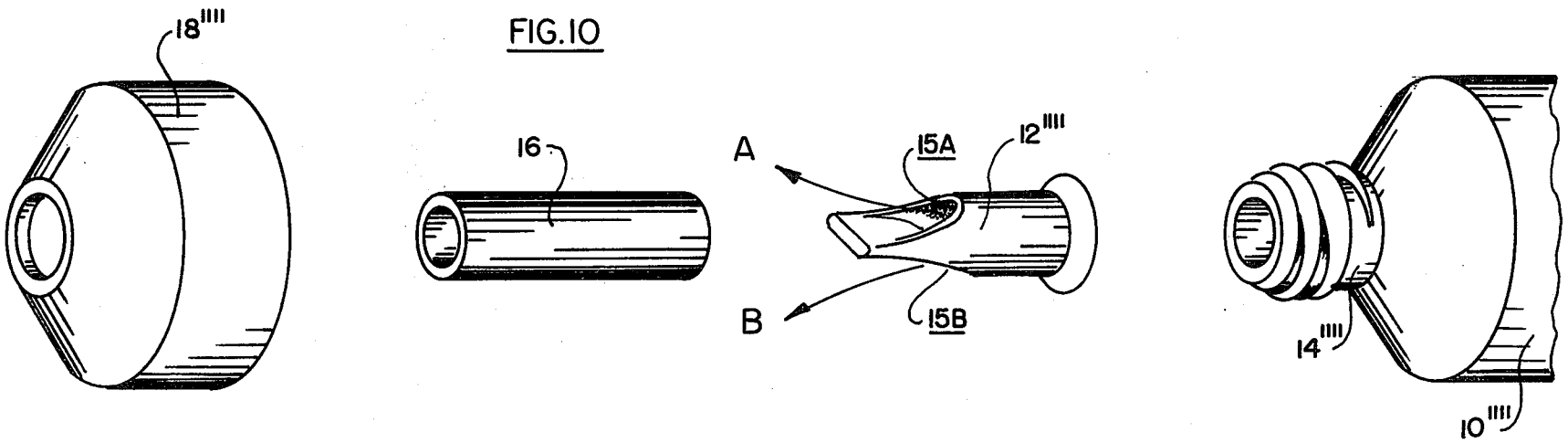
FIG. 10 is a perspective exploded representation of a further embodiment which incorporates a double pouch type of tube, in which separate ingredients in the two pouches are brought together and intermised during the dispensing action.

In the embodiment of FIGS. 10 and 11, the passages 15A and 15B in the nozzle tip 12'''' form separate channels in the tip which communicate respectively with two compartments in the tube 10''''. The tip 12'''' is held in place by bushing 20' which is threaded to neck 14''''. The compartments for example may contain an epoxy A and a reagent B, then when the tube is squeezed the substances A and B are emitted at the tip of the closure member so that they can mix externally and react with one another. It is clear that any of the previous embodiments can be used with the double-pouch tube of FIGS. 10 and 11.

The invention provides, therefore, an improved closure for a collapsible tube dispenser which operates efficiently to permit the fluid in the dispenser to be emitted through the closure when pressure is applied to the collapsible tube, and which acts as an efficient seal for the contents of the tube when the squeezing pressure is removed.

While particular embodiments of the invention have been shown and described, modifications may be made. It is intended in the claims to cover the modifications which come within the spirit and scope of the invention.

What is claimed is:

1. A closure assembly for a collapsible tube to control the discharge of fluids and soft solids from the tube, said tube having a neck through which the fluids and soft solids are dispensed, said closure assembly comprising: a hollow tubular tip member extending outwardly from the neck of the collapsible tube, at least one side of the tip member having an opening therein extending from said one side thereof into the hollow interior of the tip member; and a flexible sleeve open at both ends drawn over the tip member and over the opening therein in close engagement with the tip member along the length thereof, said sleeve forming a seal around the opening and around the distal end of the tip member, whereby squeezing pressure applied to the tube causes the fluids and soft solids to pass out the opening in said tip member and between the sleeve and the distal end of the tip member to be dispensed therethrough, in which said tip member has a radial outwardly-extending flange at one end thereof, and said tip member further has a plurality of longitudinal slots extending through the flange to permit the tip to be inserted into the neck of the tube in a position where the flange engages an internal shoulder in the neck.

2. A closure assembly for a collapsible tube to control the discharge of fluids and soft solids from the tube, said tube having a neck through which the fluids and soft solids are dispensed, said closure assembly comprising: a hollow tubular tip member extending outwardly from the neck of the collapsible tube, at least one side of the tip member having an opening therein extending from said one side thereof into the hollow interior of the tip member; and a flexible sleeve open at both ends drawn over the tip member and over the opening therein in close engagement with the tip member along the length thereof, said sleeve forming a seal around the distal end of the tip member, whereby squeezing pressure applied to the tube causes the fluids and soft solids to pass out the opening in said tip member and between the sleeve and the distal end of the tip to be dispensed therethrough, and which includes a cap member fitted over the tip and secured to the neck of the tube, and in which said cap member has an internal configuration complementing the configuration of the tip and flexible sleeve to fit closely over the tip and flexible sleeve and lock the sleeve in a closed position over the tip.

3. A closure assembly for a collapsible tube to control the discharge of fluids and soft solids from the tube, said tube having a neck through which the fluids and soft solids are dispensed, said closure assembly comprising: a hollow tubular tip member extending outwardly from the neck of the collapsible tube, at least one side of the tip member having an opening therein extending from said one side thereof into the hollow interior of the tip member; and a flexible sleeve open at both ends drawn over the tip member and over the opening therein in close engagement with the tip member along the length thereof, said sleeve forming a seal around the opening and around the distal end of the tip member, whereby squeezing pressure applied to the tube causes the fluids and soft solids to pass out the opening in said tip member and between the sleeve and the distal end of the tip member to be dispensed therethrough, and in which said tip has two separate channels therein and two openings extending into the respective channels located on either side of the tip, and in which said tube has two internal compartments separated by a wall integral with said tip to dispense two separate fluids through the separate channels of the tip and through the openings therein to be ejected therefrom between the sleeve and the tip at the distal end of the tip.

* * * * *